United States Patent [19]

Wilde

[11] 3,977,329

[45] Aug. 31, 1976

[54] SHOCK-ACCELERATION ACTIVATED FUNCTION SELECTOR

[75] Inventor: Gerald L. Wilde, Scottsdale, Ariz.

[73] Assignee: Motorola, Inc., Chicago, Ill.

[22] Filed: Oct. 25, 1974

[21] Appl. No.: 517,994

[52] U.S. Cl. ..... 102/70.2 R; 102/78

[51] Int. Cl.[2] ..... F42C 11/00

[58] Field of Search ..... 89/6, 6.5, 1 B; 102/70.2 R, 78

[56] References Cited

UNITED STATES PATENTS

| | | | |
|---|---|---|---|
| 2,990,777 | 7/1961 | Garman | 102/70.2 R |
| 3,362,330 | 1/1968 | Lagerström et al. | 102/70.2 P |
| 3,362,331 | 1/1968 | Lagerström et al. | 102/70.2 P |
| 3,529,549 | 9/1970 | Hazelet et al. | 102/70.2 R |
| 3,793,956 | 2/1974 | Nordgren | 102/70.2 R |
| 3,839,963 | 10/1974 | Nathan et al. | 102/78 X |

*Primary Examiner*—David H. Brown

*Attorney, Agent, or Firm*—Sang Ki Lee; Vincent J. Rauner

[57] ABSTRACT

A mode selector device, such as might be used in a projectile, allowing a simple manual adjustment before firing time to enable a function upon firing. A safe, small, reliable, "fail-useful" mechanism using shock to activate a cutter which removes a particular short in the circuit for each of a plurality of functions.

5 Claims, 7 Drawing Figures

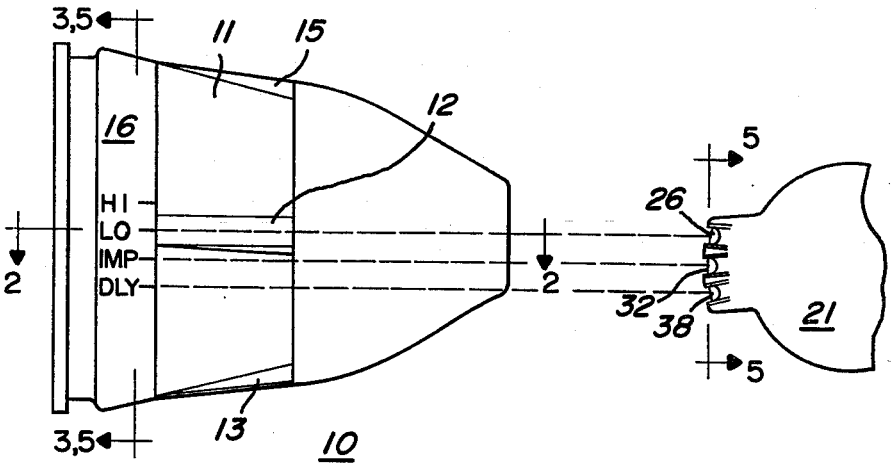
FIG. 1
FIG. 3
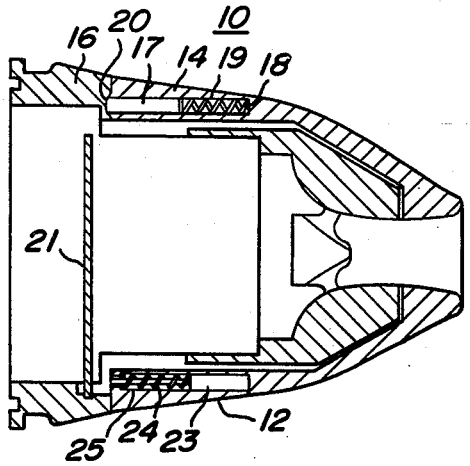
FIG. 2
FIG. 5
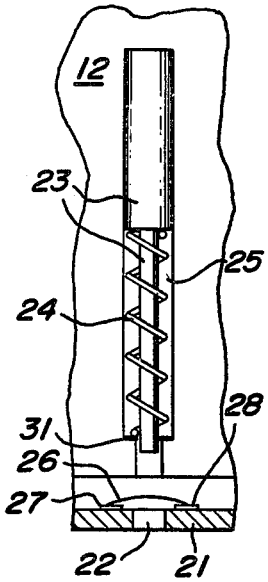
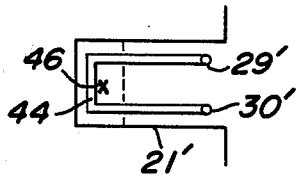
FIG. 6
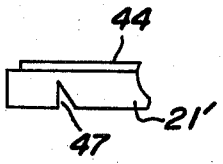
FIG. 7
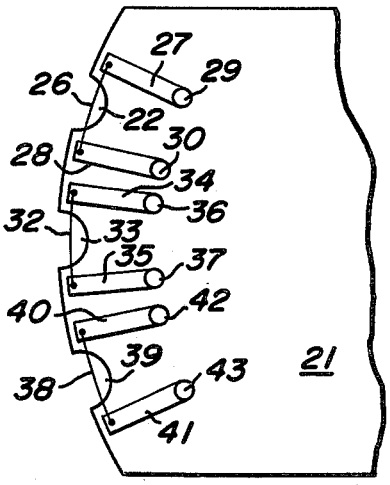
FIG. 4

SHOCK-ACCELERATION ACTIVATED FUNCTION SELECTOR

BACGROUND OF THE INVENTION

1. Field of the Invention

This invention relates to selector devices and more particularly to devices for allowing a choice of function to be made at the time of use.

2. Prior Art

There are two main methods now in use for selecting mode function. Simply making a portion of the electronic control circuit available to the user so that a particular wire or other connecting device may be broken is one of them. This action alters the circuit in such a way as to enable one specific function. This method, however, is irreversible and generally requires a tool. Each of these limitations may be a handicap under the rigorous conditions of actual use.

A specially designed selector switch is more commonly used but is costly, requires considerable space, is sometimes unreliable, and is difficult to connect to its associated circuitry by means of automated assembly techniques.

SUMMARY

Therefore, it is a general object of this invention to eliminate the aforementioned rotary switch and provide an improved mode selector.

It is a specific object of this invention to provide a mode selector that requires less space than a rotary switch, this being particularly desirable for smaller sizes.

It is another object of this invention to provide higher reliability for the selection of modes than is now provided by said rotary switch.

It is still another object of this invention to provide a mode selector which is compatible with automated assembly techniques.

Further objects and advantages of the invention will become apparent as the description proceeds.

In accordance with the present invention, the aforementioned and other objects are achieved by providing a selection apparatus in a device subjectable to shock, wherein, the selection apparatus includes means for operating the device in different modes. Illustratively, the selection apparatus may include means for providing a plurality of modes of operations, means for selecting a mode of operation, and means to activate the selecting means when the device is subjected to a shock. Such a shock initiated operating device may be designed to operate when the device is subjected to a sudden acceleration or deceleration. It may be advantageously utilized in a projectile in actuating burst after a selected duration of time delay or to select the method by which burst is actuated.

BRIEF DESCRIPTION OF THE DRAWINGS

FIG. 1 is a view of the nosecone of a projectile in accordance with the invention.

FIG. 2 is a cross sectional view taken along the line 2—2 of FIG. 1.

FIG. 3 is a partial top view of a substrate in accordance with the invention, taken along the line 3—3 of FIG. 1.

FIG. 4 is an enlarged view of the slotted portion of the substrate shown in FIG. 3.

FIG. 5 is an enlarged partial cross sectional view of the substrate taken along the line 5—5 of FIG. 3 and an enlarged view of the cutter mechanism as shown in FIG. 2.

FIG. 6 is a plan view of a section of a substrate of an alternate embodiment of the invention.

FI. 7 is a side view of a substrate portion shown in FIG. 6.

DESCRIPTION OF THE PREFERRED EMBODIMENTS

Referring more specifically to FIGS. 1 and 2, a 60 mm projectile nosecone section 10 is illustrated that has a manually-rotatable function selector ring 11 which has four ribs 12, 13, 14 and 15 to assist manual gripping. The ring 11 can be rotated by hand to align a scribed line on rib 12 with any one of four lines scribed on a housing 16 labeled HI, LO, IMP and DLY as shown in FIG. 1. For easier identification of mode functions under adverse lighting conditions, the scribed lines may be augmented or replaced by small protuberances (not shown) on the surfaces of the ring 11 and the housing 16, with the protuberances being coded in any suitable fashion to indicate the various mode function positions.

As shown in FIG. 2, positive alignment or "locking in" is assured by a detent shaft 17 and a coil spring 18 contained within a cylindrical cavity 19 in the rib 14. This detent, or any equivalent detent device, holds the ring 11 firmly when the spherical end of the shaft 17 becomes recessed in one of four detent holes 20 (only one is shown) in the housing 16, corresponding to the desired alignment of the scribed lines as described above. The alignment of the scribed lines is for the purpose of selecting one of four function modes of the projectile fuze. These function modes are; proximity burst HI, near surface burst LO, impact burst IMP, and delay after impact burst DLY. It is obvious that using other function modes or changing the number of function modes may be done without departing from the spirit or scope of the invention.

Referring to FIG. 2, an electronic circuit (not shown in its entirety) on a substrate 21 is designed so that breaking a particular wire in the circuit will select a corresponding function mode. Delay after impact burst, impact burst, and near surface burst require wire cutting while normal proximity burst requires no change in the circuit. The wires to be severed are attached to the circuit along the perimeter of the substrate 21, each bridging a slot in the edge of the substrate, as shown in FIG. 3 and its FIG. 4 enlargement. Cutting the chosen wire is done in a manner similar to the operation of a punch and die, with a slot in the substrate 21 under the wire being the "die" and the "punch" being a steel cutter 23 loaded by a coil spring 24.

Referring to rib 12 in FIGS. 1 and 2 and enlarged cross sectional view of portions of the rib and the substrate 21 in FIG. 5, the cylindrical cutter 23 is slideably positioned within a cylindrical cavity 25 in the rib 12, directly above a wire 26. Referring also to FIGS. 3 and 4 one end of the wire 26 is attached to a conductor 27 on the substrate 21 and the other end of the wire 26 is attached to a conductor 28. The conductors 27 and 28 are connected to electronic circuit terminals 29 and 30, respectively. When the wire 26 is broken, the electronic circuit is set for the near surface LO burst mode. Referring again to FIGS. 2 and 5, the cylindrical steel cutter 23 consists of a larger diameter "weight" section, which slides easily within the cavity 25, and a smaller diameter "cutter" section, which is concentric with the "weight" section and is encircled by the spring 24. The spring and the cutter are held in position by a retaining ring 31 until firing occurs. When a projectile utilizing the nose section 10 is fired the setback force caused by the projectile's acceleration makes the cutter 23 compress the spring 24 and sever the frangible wire 26 as the cutter passes through the slot 22 in the substrate 21. Thus the electronic circuit on the substrate is set for near surface LO burst by firing the projectile.

Rotating the function selector ring 11 to the IMP position aligns the cutter 23 with a wire 32 that bridges a slot 33 in the substrate 21 as shown in FIG. 4. The wire 32 is connected by means of conductors 34 and 35 to the terminals 36 and 37. When the projectile is fired, the setback force causes the cutter 23 to sever the wire 32 thus removing the short circuit across terminals 36 and 37, and setting the electronic circuit for impact IMP burst.

Similarly, rotating function selector ring 11 to the DLY position aligns the cutter 23 with a wire 38 above a slot 39 in the substrate 21. The wire 38 is connected by means of connectors 40 and 41 to terminals 42 and 43. Upon firing the projectile, the cutter severs the wire 38 removing the short circuit across the terminals 42 and 43 and setting the electronic circuit for delay after impact DLY burst.

When the function selector ring 11 is set at the HI position the cutter 23 is not aligned with any wire or any portion of substrate 21. Therefore, movement of the cutter weight upon firing of the projectile does not cause a change in the electronic circuit. The circuit then remains set for normal proximity HI burst.

Instead of severing a wire to set a function mode, as described above, an alternate embodiment can be used which can be understood by reference to FIGS. 6 and 7, wherein parts similar to those of the first embodiment are indicated by the same numbers with primes added. FIG. 6 is a plan view of a section of a substrate 21′ which is analogous to the previously described portion of the substrate 21 containing wire 26, conductors 27 and 28, and terminals 29 and 30. FIG. 7 is a side view of the substrate section shown in FIG. 6. In this embodiment a conductor or metalized track 44 on the substrate 21′ is connected between terminals 29′ and 30′ of the electronic circuit that controls the function mode. Rotating the function selector ring 11 to the LO position aligns the cutter 23 with a point 46 in FIG. 6. Firing the projectile forces the cutter against the substrate 21′ at the point 46, causing the substrate and the conductor 44 to break off at a notch 47. Thus, the short circuit between the terminals 29′ and 30′ is removed, setting the electronic circuit for near surface LO burst as before. The other modes would be selected in analogous fashion.

The nose sections 10 will be shipped, and most often fired, with the normal proximity HI mode setting. In this situation, the cutter 23 does not perform a function. In any other mode setting, if on rare occasion the cutter fails to sever the intended wire or conductor, a useful normal proximity function results. Thus very high reliability of operation is effected.

Selection of any one of the four function modes can be made or changed easily up to the time of firing, without tools and under adverse weather and lighting conditions, by means of the above described embodiments. Said embodiments, described for the smallest (60mm) mortar fuze, are compatible with automated assembly techniques, can be mass produced at low cost and can also be easily adapted for use with larger projectiles.

Other applications of these embodiments include all gunfired projectiles containing electrical apparatus wherein it is desirable to have functions which are selectable before firing but enabled upon firing or wherein a change of function upon firing is desired, such as removing of a short circuit from a detonator, enabling an arming ciruit, or selecting a time to arm, time to burst, time to deploy a parachute, or other similar function.

The foregoing description of the embodiment of the invention is by way of example only and not intended to limit the scope of the appended claims. No attempt has been made to illustrate all possible embodiments of the invention, but rather only to illustrate its principles and the best manner presently known to practice it. Therefore, such other forms of the invention as may occur to one skilled in this art upon reading the foregoing specification are also within the spirit and scope of the invention, and is intended that this invention include all modifications and equivalents which fall within the scope of the appended claims.

What is claimed is:

1. A mode function selector in a device which includes means for enabling the device to perform a function in different modes, when the device is subjected to a shock, the selector comprising:
   a. circuit means having a plurality of conductive paths associated with said different modes,
   b. shock actuable cutting means,
   c. means for aligning selected one of said plurality of different conductive paths with said shock actuable cutting means, and
   d. detent means for locking said aligning means in the selected one of the modes, whereby, when said device is subjected to the shock, said cutting means is actuated to sever the selected path to effect the selected mode of operation.

2. The selector, according to claim 1, wherein said device is a projectile and said mode functions are the functions of said projectile.

3. The selector according to claim 1, wherein said shock actuable cutting means includes punch and die means.

4. The selector according to claim 3, said cutting means includes spring means for positioning the punch means adjacent the selected path so that the punch is actuable to sever the selected path when the device is subjected to the shock.

5. The selector according to claim 4, wherein said aligning means, said detent means and said circuit means are adapted so that non-operation of said punch and die means also provide a useful mode of operation.

* * * * *